United States Patent [19]

Deuser

[11] 4,210,135

[45] Jul. 1, 1980

[54] MASSAGING DEVICE

[76] Inventor: Erich Deuser, Grupellostrasse 24, 4000 Dusseldorf, Fed. Rep. of Germany

[21] Appl. No.: 935,896

[22] Filed: Aug. 22, 1978

[30] Foreign Application Priority Data

Aug. 24, 1977 [DE] Fed. Rep. of Germany ..... 2738060

[51] Int. Cl.[2] ..... A61H 7/00

[52] U.S. Cl. ..... 128/57; 128/62 R

[58] Field of Search ..... 128/57, 60, 24.3, 67, 128/62

[56] References Cited

U.S. PATENT DOCUMENTS

| | | | |
|---|---|---|---|
| 731,693 | 6/1903 | Lennox | 128/57 |
| 1,757,004 | 5/1930 | Chapin | 128/57 |
| 2,248,525 | 7/1941 | Fleissner | 128/60 |
| 2,505,610 | 4/1950 | Ellinger | 128/62 |
| 3,645,256 | 2/1972 | Morrison | 128/57 |

FOREIGN PATENT DOCUMENTS

| | | | |
|---|---|---|---|
| 1013869 | 5/1952 | France | 128/57 |

*Primary Examiner*—Lawrence W. Trapp
*Attorney, Agent, or Firm*—Thomas R. Morrison

[57] ABSTRACT

A plurality of non-rotating disc-shaped massaging members are fixed on a flexible shaft held at its ends by a bow. Spherical rolling members between the massaging members space the massaging members apart and limit their depth of depression into the skin.

25 Claims, 7 Drawing Figures

MASSAGING DEVICE

BACKGROUND OF THE INVENTION

The invention relates to a massaging device in which a plurality of massaging members are arranged on a shaft borne by a carrier, particularly bow-shaped, provided with a handle.

In a known massaging device of this type the massaging members consist of spheres arranged rotary close together on a rigid shaft. An adjustable mechanism allows one or three spheres to be inserted at will. With this device, however, only superficial therapeutic stimuli are produced in the region of the massaged surface. Even when the spheres are pressed against the surface of the skin fairly energetically, the depth effect is only slight. In addition, the surface massaged in each instance is relatively small; because of the rounded contours of the body, even an increase in the number of spheres would increase the massaged surface only slightly.

There is further known a massaging apparatus in which a shaped rubber roller is arranged rotary on a bow provided with a handle. This roller, to be sure, is adjustable to the rounded contours of the human body. The massaging effect, however, is likewise slight.

SUMMARY OF THE INVENTION

The object of the invention is to procure a massaging device for self-massage, the effect of which corresponds largely to manual massage by another person and in particular further permits the production of deeper therapeutic stimuli without any great expenditure of energy.

This object is obtained pursuant to the invention in that the massaging members are arranged spaced apart and fixed against rotation on the shaft and in that the shaft is designed flexible and is joined, fixed against rotation, with the carrier.

This device permits effortless self-massage, this massage having the advantages of manual massage by another person. Stroking, tapping, kneading and rubbing movements may be performed by means of the spaced-out massaging elements not rolling over the skin. Since the parts of the skin are able to escape outward between the massaging elements, this therapeutic stimulation may be accomplished without great expenditure of energy. There is likewise no irritation of the skin or roots of hairs. The flexibility of the shaft permits adjustment to all body contours. Even the regions of the joints at the foot, knee, elbow and shoulders can be massaged effortlessly and over a large area. The force with which the massaging members are pressed against the human body is determined basically by the force with which the entire device is pressed against the body. In addition, however, by placing the free hand on the massaging elements the massages may be still more precisely administered and guided.

There is a further advantage in that therapeutic pharmaceutical substances may be distributed uniformly over the parts of the body to be treated with the massaging device. The therapeutic substances are herein not only distributed on the surface of the skin, but are massaged deeply into the parts of the body to be manipulated. Since the device is actuated by the force of the body itself and has no outside motive force, it may alternatively be used for a massage under water, either in the bathtub or in a humid chamber, such as a shower or sauna, with no danger of the human body under treatment being exposed to electric shock. The device thus not merely comes very close in effect to manual massage by another person, but surpasses this by the combination of physical effects possible (massage, therapeutic substance, heat and water).

In a preferred embodiment rolling members are arranged rotary on the shaft between the massaging members, the radius of which rolling members is smaller than the distance of the effective area of massage of the massaging members from the center line of the shaft. These rolling members prevent skin and tissue from being pressed out too hard between the massaging members. When these pressed-out parts come in contact with the rolling members, they are subjected to practically no stress at all, as the rolling member rolls across the skin with little force. In particular these rolling members permit the use of massaging members having a relatively great diameter, which because of the correspondingly great curvature can be moved over the surface of the body relatively easily, even when they are pressed into the skin.

The rolling members preferably have a spherical shape. These spheres, even with deformation of the shaft, retain an approximately uniform effectiveness. Since because of the unlike rolling radius the spheres ride with unlike rolling speed on the parts of the skin pressed out, an additional frequently sought rubbing effect is produced.

The massaging members should preferably have the shape of a disk, in particular essentially the shape of an ellipsoid. This permits gentle but nevertheless deep penetration into the surface of the body.

In addition, the massaging members, for adjustment to the rolling members, may have lateral recesses. This permits very strong deformations of the flexible shaft, without interlocking of massaging and rolling members.

It is advantageous if the massaging and rolling members consist of synthetic material, in particular polyamide. A smooth surface is obtained, one which slides on the skin with little friction. Further, these parts may be cleaned readily. Instead of this, the aforesaid members may alternatively consist of wood, horn, metal, glass or other solid material.

It is advisable to render the massaging members particularly secure against rotation on the shaft, since forced fits or the like may detach in case of the given stress, in particular with a flexible shaft. In the simplest case cementing will suffice. Alternatively, however, a shaft with multiple-cornered cross section and a correspondingly shaped opening in the massaging members may be used. It is particularly advantageous, however, if the massaging members have a center opening with keyway and are secured against rotation by means of keys mounted at intervals on the flexible shaft.

So that the shaft may adjust to the contours of the body with the least possible expenditure of energy, it should be longitudinally extensible. Instead of this, the bow-shaped carrier may alternatively be elastically deformable.

The flexibility and extensibility of the shaft is most simply obtained by its being constructed of a spring shaft, i.e. a tightly wound helical spring with an approximately cylindrical surface.

For fastening to the carrier, mountings are advantageously soldered or welded on at the ends of the shaft. Such mountings may consist of flat steel and may be provided with a mounting hole matching a mounting hole in the carrier, the two holes being penetrated by a common fastening element, such as a screw or a rivet. Another mounting consists of a threaded part, for example a threaded bolt, cooperating with a second threaded part, for example a nut, reaching through the carrier.

Especially preferably, however, will be a mounting consisting of a pin having a head and an adjoining key, while in the carrier is provided a cut open laterally, which has a width corresponding to the diameter of the pin and is provided with a keyway for receiving the key. This results in particularly simple assembly, because the pin needs only to be pushed into the cut by its part not occupied by the key, whereupon the key under the influence of th force of expansion of the shaft or of the spheres engages in the keyway, so that the shaft is held fast against rotation in the carrier.

The ends of the flexible shaft and/or the mountings may be concealed by coverings. This is not only visually more pleasing, but alternatively permits the device to be used up to close to the ends for massaging. The covering for a shaft end may for example consist of two hemispherical dishes with surfaces of separation perpendicular to the shaft. Another covering has two dishes whose surface of separation lies in the plane of the sphere.

Structurally it is advantageous if the carrier has a metal sphere, at least partially sheathed with synthetic material, for attachment of the flexible shaft. The metal sphere is then able to receive the forces appearing, while the synthetic material needs to contribute only slightly to the stability. The metal sphere may, for example, be coated with synthetic material. It may alternatively be provided with two dishes of synthetic material.

In addition, the covering of synthetic material may have a continuation which forms a stemmed handle lying perpendicular to the shaft. A simple metal sphere suffices as stiffening, even in complicated shapes.

The cover of synthetic material may alternatively form a handle roughly conforming to the center section of the sphere.

In some cases it is advantageous if the handle is adjustable or interchangeable. Adjustability permits a handle arrangement adapted to the purpose in each case. Interchangeability permits the use of handles of a variety of lengths, for example in order to be able to massage the parts of one's own back better.

In addition, there is the possibility of providing a carrier with more than one flexible shaft with massaging members arranged at intervals, in order to be able to this fashion to massage still greater areas simultaneously or more intensively.

An additional massaging member for point-by-point massage is advantageously arranged stationary on the carrier, preferably at the end of a stemmed handle. This massaging member permits targeted massaging manipulations, as are otherwise performed with the fingertips.

There is on the whole obtained a massaging device which may be used particularly for self-massage, but alternatively for massage by another person, and hence is useful for enhancing physical fitness and strength and eliminating complaints of the locomotor apparatus in humans (muscles, tendons and joints).

BRIEF DESCRIPTION OF THE DRAWINGS

The invention is described in greater detail below, by means of the example represented in the drawing, in which.

DETAILED DESCRIPTION OF THE PREFERRED EMBODIMENT

Figure 1:
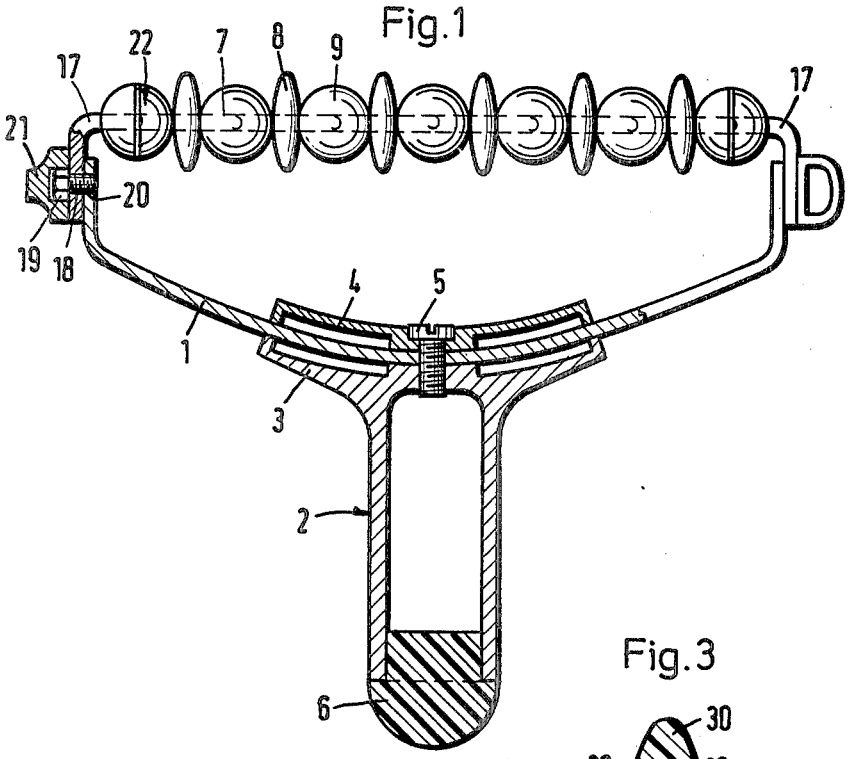
FIG. 1 shows, partly in view, partly in section, a first embodiment of a massaging device.
Figure 2:
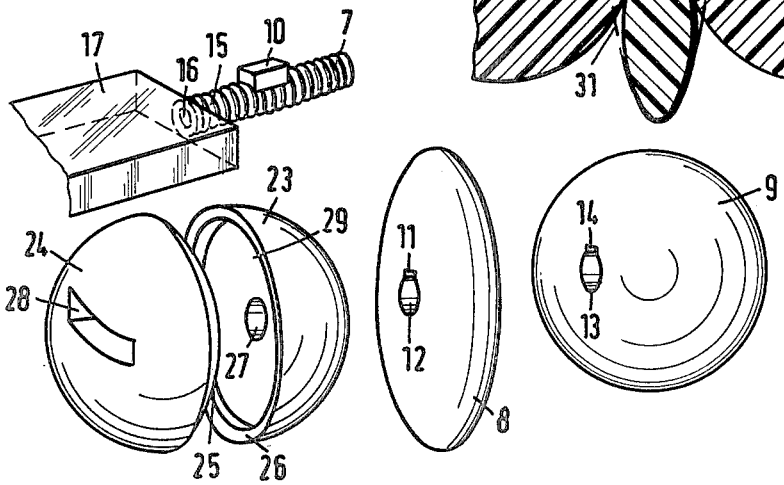
FIG. 2, in three-dimensional representation, the end piece of the flexible shaft and the covering, massaging and rolling members to be arranged in this region, FIG. 3, a section through another embodiment of a massaging member, FIG. 4, partly in view, partly in section, an additional embodiment of a massaging device, FIG. 5 in view, an additional embodiment, FIG. 6, in section, the end region of the flexible shaft of FIG. 5 and FIG. 7, in side view, a bow end.

In the embodiment of FIGS. 1 and 2 is provided a bow 1 consisting of flat stainless steel, which in its center carries a handle 2. The handle 2 is part of a plastic dish 3, which rests against the bow 1 from the outside. A second dish 4 rests against the bow from inside. All parts are held together by means of a screw 5, which engages in a thread of the plastic part 3. At the lower end of the handle is inserted a massaging element 6, making point-by-point massage possible.

On a flexible shaft 7, formed by a spring shaft, are alternately arranged massaging members 8, fixed against rotation, and rotary rolling members 9. The massaging members 8 have the shape of an ellipsoid, the rolling members 9 the shape of a sphere. The massaging members for example have a diameter of 22 mm and the spheres a diameter of 18 mm. In massage the massaging members 8 may therefore be pressed into the surface of the body one member deep, while at the same time skin and tissue parts lying between them may be pushed aside outward by a definite amount.

The rotational fixation of the massaging members 8 is obtained by means of keys 10 soldered on the flexible shaft 7, which keys engage in the corresponding keyways 11, adjoining the center bore 12 of the massaging members 8. The bores 13 of the rolling members 9 likewise have such keyways 14, so that they may be pushed over the keys 10. Since there is no key in their region, the rolling members 9 are freely rotary. Alternatively, the massaging members 8 may be affixed to the flexible shaft by gluing, soldering or other means.

The ends 15 of the flexible shaft 7 are soldered firmly at the face 16 to a mounting 17 of flat steel bent angular. Each mounting 17 has a mounting hole 18, through which extends a screw 19 engaging by its thread in a thread 20 at the end of bow 1. The head of the screw is provided with a toggle 21 made of plastic, for simplifying operation and for protection.

For protection of the soldered joint is provided a covering 22, consisting of two hemispheres 23 and 24, the end 25 of the hemisphere 24 fitting clampingly under the edge 26 of the hemisphere 23. The hemisphere 23 is pushed with its center hole 27 onto the shaft 7, the hemisphere 24 with its slot 28 over the mounting 17. Then when the shaft 7 and the mounting 17 are soldered together, the two hemispheres may be pushed together and connected by clamps. The position of this sphere is secured in that on one side a massaging member 8 is held on the adjacent key 10 in a forced fit and hence axially secured, while on the other side the inner surface 29 of the hemisphere 23 is able to come to rest on the face of the mounting 17.

Figure 3:
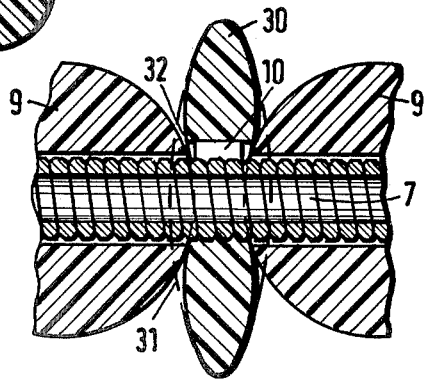

In the embodiment of FIG. 3 a massaging member 30 is arranged on the shaft 7 between two spherical rolling members 9, which member 30 has lateral recesses 32 in opposed position to the ellipsoid shape 31, which recesses are adjusted approximately to the spherical shape, so that mobility is retained even with a heavily bent shaft 7.

Figure 4:
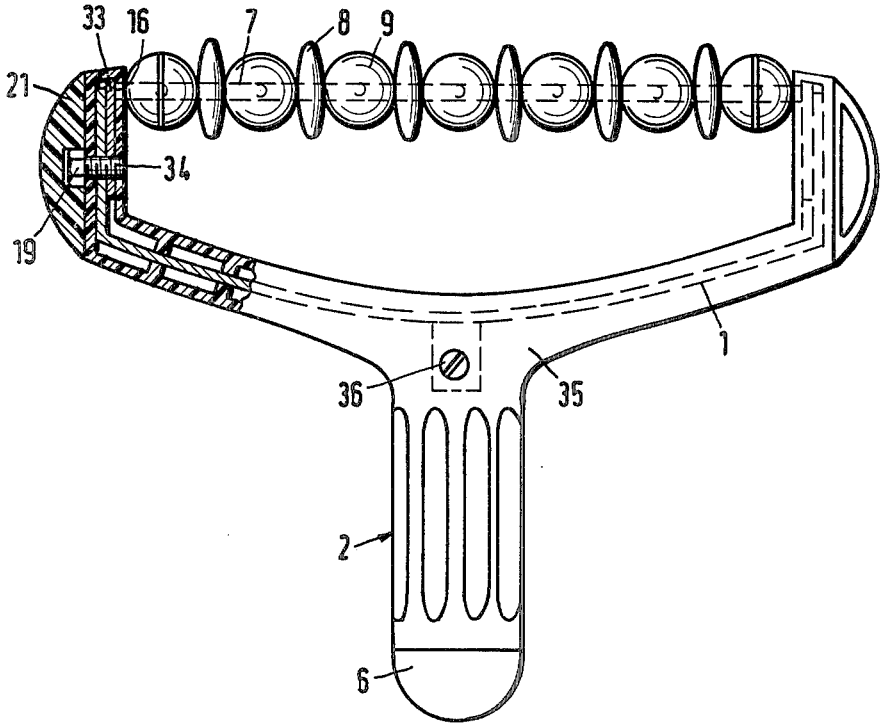

There is a variation in the embodiment of FIG. 4, in relation to that of FIG. 1, insofar as the mounting 33 is soldered not by the face, but by the flat side at the face 16 of the shaft 7 and again carries the thread 34 for the screw 19 provided with the toggle 21. In addition, the plastic covering of bow 1 consists of two plastic dishes 35, which are pushed on the bow from either side by means of a screw 36. The ends of these plastic dishes extend to the mounting 33 and form the covering thereof.

Figure 5:
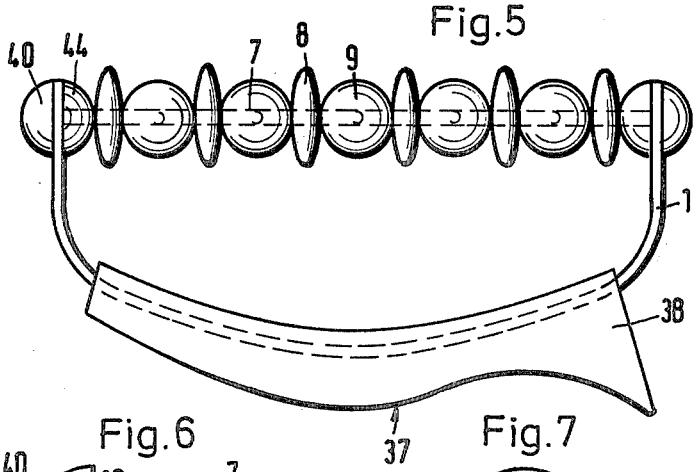
Figure 6:
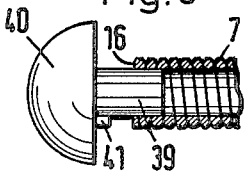
Figure 7:
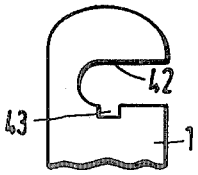

In the embodiment of FIG. 5 the bow is provided not with a stemmed handle as in FIGS. 1 and 4, but with a handle 37 provided the length of the bow, which is injected as plastic coating 38 around the center section of the bow. As revealed in FIGS. 6 and 7, a pin 39 is soldered in the ends of the flexible shaft 7, which pin has a head 30 and, adjoining the head 40 but at a distance from the face 16 of the shaft 7, a key 41. The ends of the bow 1 are provided with a notch 42 open toward the side, the width of which matches the diameter of the pin 39 and which has a keyway 43 for the introduction of the key 41. The shaft 7, provided with its pin 39 and all massaging members 8 and rolling members 9, is extended slightly and pushed by the free pin sections into the notches 42. When the tensile stress is at an end, the pinheads 40 are pulled against each other, permitting the keys 41 to snap into the keyways 43. The rotational fixation of the shaft 7 is thereby secured. For covering the ends of the shaft 7 are provided hemispheres 44, which may be similar in operation to the rolling members 9.

Numerous modifications of the embodiments illustrated are possible. For example, the handle 2 of FIG. 1 may very easily be replaced by another, longer, bent handle, so that parts of the back may be more easily reached. The massaging and rolling members here consists of polyamide; they may however alternatively consist of wood, metal or many other synthetic materials. The bow may be made pf steel, aluminum, other metals or plastic, it may be flat or round in section, it may be designed stiff or springy. When the bow is elastic and hence longitudinal extensibility of the shaft 7 does not matter, the latter may alternatively consist of a flexible rod or tube. The flexible shaft 7 may alternatively consist of spring steel wires or strips wound, twisted stranded or woven together. It may alternatively have a covering. If necessary, a shaft of rubber-like material may alternatively be possible. In some cases it will suffice to make the cylindrical bores in the massaging members smaller than the cylindrical bores in the rolling members, so that the massaging members are force-fitted on the shaft 7, the rolling members in contrast having a free sliding fit. Another alternative consists in fastening the handle 37 of FIG. 5 rotary on the bow 1, so that it will be capable of rotation from a position parallel to the center section of the bow into a position swung out of the plane of the bow.

The force that must be exerted on the device in order to effect bending of the shaft 7 may be expected to be on the order of about 1.5 to 2 kg. The axial prestress in the built-in state may be almost zero.

It will be understood that the claims are intended to cover all changes and modifications of the preferred embodiments of the invention, herein chosen for the purpose of illustration which do not constitute departures from the spirit and scope of the invention.

What is claimed is:

1. A massaging device comprising:
(a) a flexible shaft;
(b) bow means for holding the ends of said flexible shaft;
(c) a handle attached to said bow means;
(d) a plurality of massaging members on said flexible shaft;
(e) spacer means for spacing at least some of said massaging members apart from each other;
(f) first fixing means for fixing said massaging members to said flexible shaft to prevent substantial rotation therebetween;
(g) second fixing means for fixing said flexible shaft to said bow means to prevent substantial rotation therebetween;
(h) said spacer means being rolling members arranged on said flexible shaft between the massaging members, the radius of said rolling members being smaller than the radius of adjacent massaging members from the center line of the flexible shaft; and
(i) said rolling members having a spherical shape.

2. A massaging device according to claim 1 wherein the massaging members have a disk shape.

3. A massaging device according to claim 2 wherein the massaging members have essentially the shape of an ellipsoid.

4. A massaging device according to claim 2 or 3 wherein said massaging members have lateral recesses, said rolling members being accommodated within the lateral recesses of adjacent massaging members over a range of substantial flexure of said flexible shaft.

5. A massaging device according to claim 1 wherein the massaging members and rolling members consist of synthetic material.

6. A massaging device according to claim 1 wherein said first fixing means is a cement bond.

7. A massaging device comprising:
(a) a flexible shaft;
(b) bow means for holding the ends of said flexible shaft;
(c) a handle attached to said bow means;
(d) a plurality of massaging members on said flexible shaft;
(e) spacer means for spacing at least some of said massaging members apart from each other;
(f) first fixing means for fixing said massaging members to said flexible shaft to prevent substantial rotation therebetween;
(g) second fixing means for fixing said flexible shaft to said bow means to prevent substantial rotation therebetween; and
(h) said first fixing means including a center opening having a keyway in the massaging members, at least one key on said flexible shaft, and said keyway engaging said key whereby substantial rotation between said massaging member and said flexible shaft is prevented.

8. A massaging device according to claim 1 wherein the flexible shaft is longitudinally extensible.

9. A massaging device according to claim 8 further comprising said flexible shaft being a spring shaft.

10. A massaging device according to claim 1 wherein said bow means is elastically deformable.

11. A massaging device according to claim 1 further comprising mounting means affixed at the ends of the flexible shaft for fastening to said bow means.

12. A massaging device according to claim 11 wherein the mounting means comprises a first threaded part cooperating with a second threaded part extending through the bow means.

13. A massaging device comprising:
(a) a flexible shaft;
(b) bow means for holding the ends of said flexible shaft;
(c) a handle attached to said bow means;
(d) a plurality of massaging members on said flexible shaft;
(e) spacer means for spacing at least some of said massaging members apart from each other;
(f) first fixing means for fixing said massaging members to said flexible shaft to prevent substantial rotation therebetween;
(g) second fixing means for fixing said flexible shaft to said bow means to prevent substantial rotation therebetween;
(h) mounting means affixed at the ends of the flexible shaft for fastening to said bow means; and
(i) said mounting means consisting of flat steel, a first mounting hole in said mounting means, a second mounting hole in the bow means matching said first mounting hole, and a common fastening element penetrating both said first and second mounting holes.

14. A massaging device comprising:
(a) a flexible shaft;
(b) bow means for holding the ends of said flexible shaft;
(c) a handle attached to said bow means;
(d) a plurality of massaging members on said flexible shaft;
(e) spacer means for spacing at least some of said massaging members apart from each other;
(f) first fixing means for fixing said massaging members to said flexible shaft to prevent substantial rotation therebetween;
(g) second fixing means for fixing said flexible shaft to said bow means to prevent substantial rotation therebetween;
(h) mounting means affixed at the ends of the flexible shaft for fastening to said bow means; and
(i) said mounting means including a pin, a head on said pin, a key adjoining said head, a laterally opened notch in said bow means which has a width corresponding to the diameter of the pin and is provided with a keyway for receiving the key.

15. A massaging device according to claim 1 further comprising the ends of at least one of the flexible shaft and the mounting means being concealed by coverings.

16. A massaging device comprising:
(a) a flexible shaft;
(b) bow means for holding the ends of said flexible shaft;
(c) a handle attached to said bow means;
(d) a plurality of massaging members on said flexible shaft;
(e) spacer means for spacing at least some of said massaging members apart from each other;
(f) first fixing means for fixing said massaging members to said flexible shaft to prevent substantial rotation therebetween;
(g) second fixing means for fixing said flexible shaft to said bow means to prevent substantial rotation therebetween;
(h) the ends of at least one of the flexible shaft and the mounting means being concealed by coverings; and
(i) said covering including two hemispherical dishes with surfaces of separation lying perpendicular to the shaft.

17. A massaging device comprising:
(a) a flexible shaft;
(b) bow means for holding the ends of said flexible shaft;
(c) a handle attached to said bow means;
(d) a plurality of massaging members on said flexible shaft;
(e) spacer means for spacing at least some of said massaging members apart from each other;
(f) first fixing means for fixing said massaging members to said flexible shaft to prevent substantial rotation therebetween;
(g) second fixing means for fixing said flexible shaft to said bow means to prevent substantial rotation therebetween; and
(h) said bow means having a metal bow and a covering of synthetic material which at least partially covers said metal bow.

18. A massaging device according to claim 17 wherein said synthetic material is injected around the metal bow.

19. A massaging device according to claim 17 wherein said covering is two dishes of synthetic material.

20. A massaging device according to claim 17 wherein the covering of synthetic material has a continuation forming a stemmed handle lying perpendicular to the flexible shaft.

21. A massaging device according to claim 17 wherein the covering of synthetic material forms a handle conforming approximately to the center section of the metal bow.

22. A massaging device according to claim 1 wherein the handle is adjustable.

23. A massaging device according to claim 1 further comprising a point-by-point massaging member.

24. A massaging device according to claim 23 wherein the point-by-point massaging member is mounted at the end of said handle.

25. A massaging device according to claim 1 wherein the handle is interchangeable.

* * * * *